United States Patent [19]

Donohue

[11] 3,993,141

[45] Nov. 23, 1976

[54] PIN CYLINDER LITTER COLLECTOR

[76] Inventor: Paul C. Donohue, 1661 Prospect Ave., East Meadow, N.Y. 11554

[22] Filed: Nov. 18, 1974

[21] Appl. No.: 524,625

[52] U.S. Cl. ..... 171/63; 56/328 R
[51] Int. Cl.[2] ..... A01B 43/00
[58] Field of Search ..... 56/328 R; 171/63; 214/356

[56] References Cited

UNITED STATES PATENTS

| | | | |
|---|---|---|---|
| 1,859,980 | 5/1932 | Mueller | 56/328 R |
| 3,101,581 | 8/1963 | Kelso et al. | 56/328 R |
| 3,746,099 | 7/1973 | Black | 171/63 |

*Primary Examiner*—Hugh R. Chamblee
*Assistant Examiner*—Daniel J. Leach

[57] ABSTRACT

A pin cylinder litter collector for picking up litter by wedging or piercing action comprising a frame, a first shaft rotatable in the frame, and rods secured spacedly radially of said first shaft with said rods having sharp pointed free ends and sleeves of resilient material mounted on them a distance from the sharp pointed ends in order to pick up litter by piercing and wedging respectively. A second shaft is mounted rotatably in the frame and cooperates with the first shaft. On this second shaft is mounted a device for removing litter from the points and in between the sleeves of the rods on the first shaft consisting of first sections which are cylinder brush sections which are aligned for removing litter from the sharp points of the rods and second sections which may be made of metal, plastic, or other suitable material, which are aligned to remove wedged litter from in between the sleeves of the rods. Means are provided to operably connect the first and second shafts, the latter being driven by the former. Litter is discharged into a container removably attached to the frame.

12 Claims, 12 Drawing Figures

PIN CYLINDER LITTER COLLECTOR

The 'litter removing device' constitutes the most significant improvement in a Pin Cylinder Litter Collector (see applicant's previous application, Ser. No. 458,281, now U.S. Pat. No. 3,923,101, issued Dec. 2, 1975,) as it is presented here. An object of this improvement is to allow the use of abrasive brush material to remove litter from the sharp points of the rods. Such brush material is not readily usable in a pin cylinder litter collector having, as a 'litter removing device', a cylinder brush of one radius throughout because that brush has to go in between the rod sleeves to remove wedged litter and would, if abrasive eventually tear up the sleeves and cause them to require replacement. An additional object of the two-section 'litter removing device' is a reduction in costs which is relizable by using metal or plastic second sections rather than a single cylinder brush.

As was the case indicated in my previously submitted patent application, the chief object of this improved device is to provide a means for the efficient collection of litter from various types of terrain.

This, and other objects of the invention, will become apparent from the following description and the accompanying three pages of drawings. It is understood, however, that these are given by way of illustration and not of limitation and that changes may be made in the detail construction, form and size of the parts, without affecting the scope of the invention sought to be protected.

Figure 1:
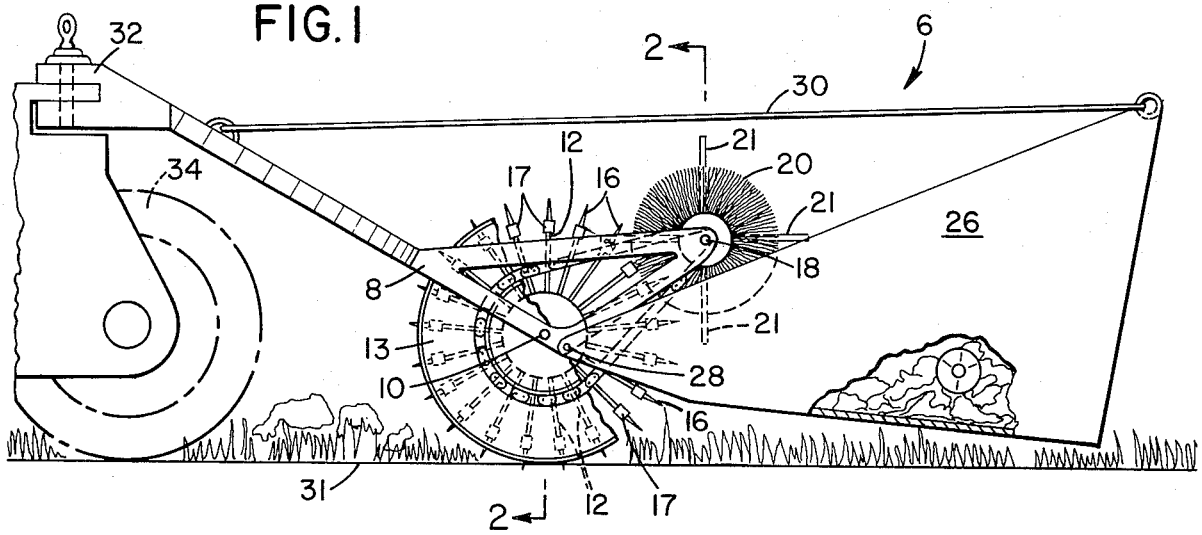
FIG. 1 is a side elevation of an embodiment of the device.
Figure 2:
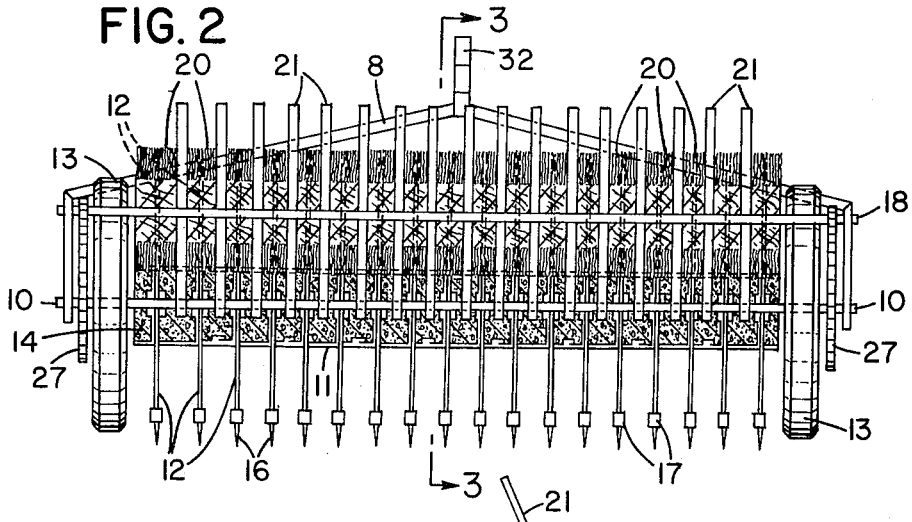
FIG. 2 is a section taken on line 2—2 of FIG. 1.

FIGS. 9, 10, 11 and 12 also show top and section views of additional embodiments of the 'litter removing device' part of the 'litter picker'.

I refer now to the drawings in detail.

FIG. 1, FIG. 2, FIG. 3:

The 'litter picker' is generally indicated as 6. It comprises a frame 8, and a first rotatable shaft 10 mounted in the frame. Fitted sections of molded plastic housing 11 are mounted on shaft 10. Flexible rods 12 are inserted through holes in plastic housing 11 and into holes in the center sleeves which are mounted on shaft 10 and are a fully attached part of housing 11. Flexible rods 12 are secured therein by a cylinder of concrete or other appropriate material 14 which is formed about shaft 10 and inside housing 11. Wheels 13 are secured to shaft 10.

The free portions of rods 12 have pointed ends 16 which extend beyond the peripheral path of wheels 13 secured to the ends of shaft 10.

Secured to the flexible rods and spaced from the pointed ends 16 are sleeves 17 of rubber or other resilient material.

Rotatably mounted in frame 8, behind cylinder 14 and slightly higher than the former on a second shaft 18 is a device for removing litter from points 16 and from between sleeves 17. This 'litter removing device' consists of first sections, cylinder brush sections 20, and second sections, metal strips 21. It is operably engaged with cylinder 14 by means of sprocket 22 on shaft 10, sprocket 24 on shaft 18 and link chain 27.

A bin or receptacle 26 for receiving collected litter, of sheet metal or other appropriate material, is detachably secured, at 28, to the rear of frame 8. A cord 30 secures the rear of the bin to the front of the frame, thereby maintaining it above and clear of the ground 31. The front part of the frame is also provided with a coupling 32, by means of which it may be attached to a propulsion vehicle 34.

Figure 3:
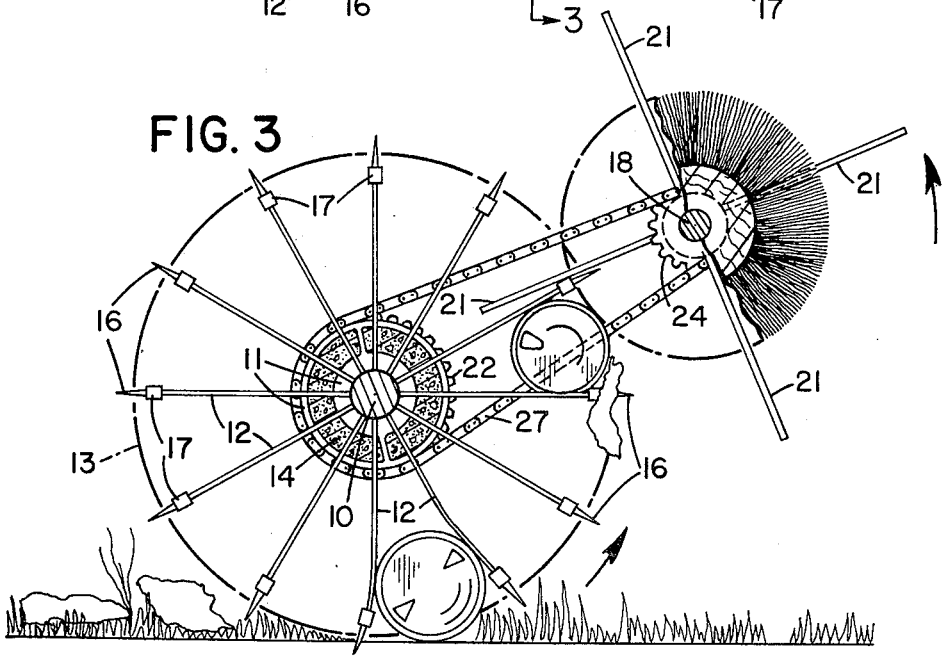
FIG. 3 is a section taken on line 3—3 of FIG. 2.

When the device is in motion, the flexible rods 12, upon contacting objects of litter, such as the cans shown in FIG. 3, spread and grasp between them these objects which they hold by frictional engagement between sleeves 17. As litter so wedged is rotated it is dislodged by the counter-rotation of one of the second sections of the 'litter removing device', in this embodiment metal strips 21, and discharged into bin 26 whence it can be removed by detaching bin 26.

In operation rods 12 also pick up paper, cardboard and similar litter by piercing these with sharp points 16. This litter then rotates into the counter-rotation of the first or brush sections 20 of the 'litter removing device' at which point it is swept or torn from the rods and discharged into bin 26.

Figure 4:
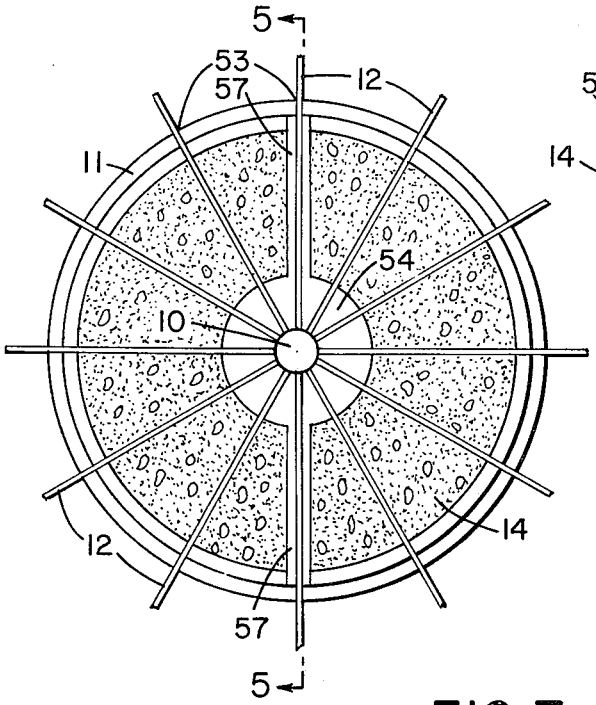
FIG. 4 shows an end view of a means of construction for attaching the rods to the first shaft of the 'litter picker'.
Figure 5:
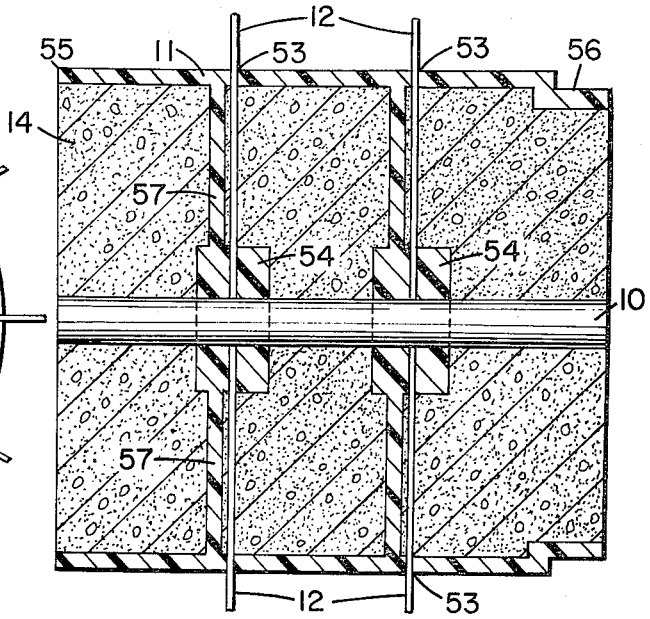
FIG. 5 shows a section taken on line 5—5 of FIG. 4.
Figure 6:
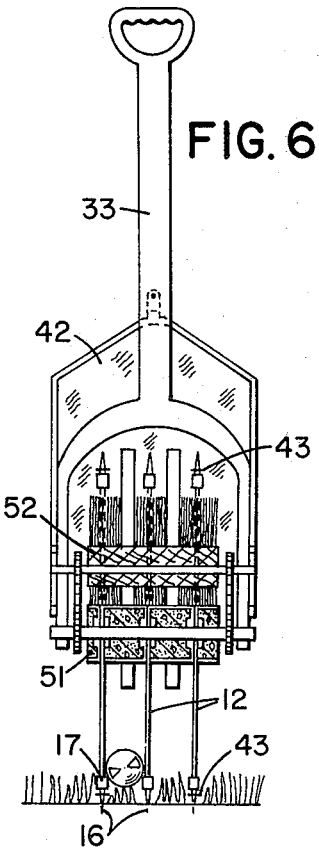
FIG. 6 shows another embodiment of the 'litter picker' for manual operation.

FIGS. 4 and 5:

These drawings show the housing used to connect rods 12 to shaft 10. Rods 12 are inserted through outer holes 53 in plastic housing 11 and then into holes in sleeves 54 which encircle shaft 10 and which are fully attached to housing 11 by strips 57. Concrete 14 or other suitable material fills the housing and causes rigid connection of rods and shaft. The small end of the housing, noted as 56 in the drawings, will push fit into the large end (55) of another section of housing made to the same specifications.

FIG. 6:

This drawing shows a manually operated embodiment of the 'litter picker' which is similar in construction to the above described device (of FIG. 1) except for its size and the substitution of handle 33 and the elimination of wheels for propulsion. Movement, in this embodiment, is effected by the engagement of spaced rods 12 with the ground.

Small welded-on pieces of metal 43 are added to a number of the rods between their sharp points 16 and their rubber sleeves 17. These metal pieces give the rods a stronger ground-engaging area. They also provide a stop which prevents paper type litter from going any higher on the rods and thereby is used to keep this type of litter away from the rubber sleeves. When used to perform this latter function these small metal pieces may be used on devices with or without wheels.

Cylinder 51 driven by the ground engagement of rods 12 in turn drives 'litter removing device' cylinder 52.

FIGS. 7,8,9,10,11,12:

These figures show top and section views consecutively of three additional embodiments of the 'litter removing device' part of the 'litter picker'. In all figures, rods 12 are shown with sleeves 17 and pointed ends 16 and are mounted radially to shaft 10, the first shaft of the 'litter picker'. In all figures shaft 18 is the second shaft of the 'litter picker' and has mounted on it the 'litter removing device' part of the 'litter picker' which consists of first or brush sections 20 which are the same in all figures and which, in operation, remove litter from the points 16 of rods 12, and second sections, for removing wedged litter, which are different in all figures.

Figure 7:
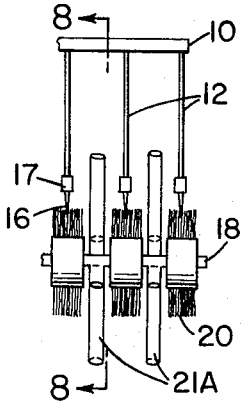
FIGS. 7 and 8 show top and section views of an additional embodiment of the 'litter removing device' part of the 'litter picker'.
Figure 8:
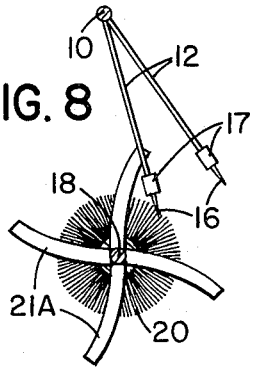

FIGS. 7 and 8:

These figures show second sections 21A which are curved tubes mounted radially to shaft 10.

Figure 9:
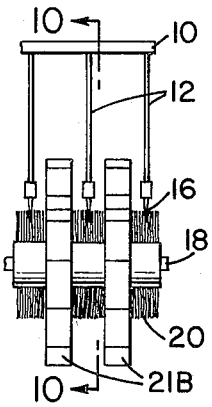
Figure 10:
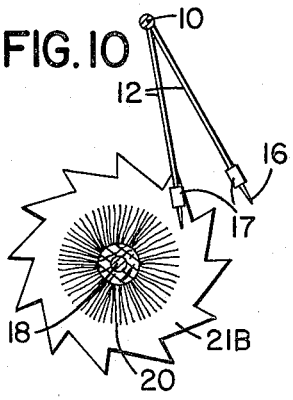

FIGS. 9 and 10:

These figures show second sections 21B which are circular pieces of suitable material whose litter engaging periphery forms a plurality of angular teeth.

Figure 11:
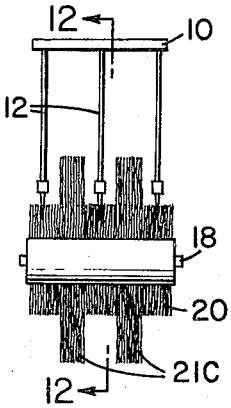
Figure 12:
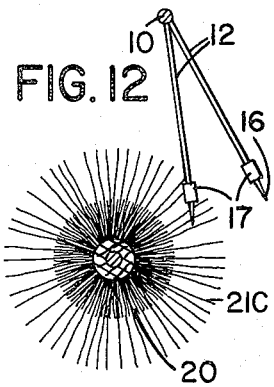

FIGS. 11 and 12:

These figures show second sections of radially attached brush material.

I claim:

1. A 'litter picker' comprising in combination a frame, a first horizontal shaft rotatably mounted in said frame, means for attaching a plurality of rods radially of said shaft, a plurality of spaced flexible rods attached to said attaching means radially of said shaft, said rods having free ends which terminate in sharp points, said free ends extending beyond the frame and to or into the surface below so as to pierce and engage paper, cardboard, and like litter thereon, said rods also provided with sleeves of resilient material for frictionally engaging litter therebetween, said sleeves being spaced a distance from said sharp points, a second shaft rotatably mounted in said frame rearwardly of said first shaft, means operably connecting said first and second shafts, a litter removing device secured to said second shaft, said device consisting of one or more first or brush sections and one or more second sections, said first or brush sections being made of radially attached brush material, with each said brush section being so aligned and of such a radius as to, upon the cooperative rotation of said first and second shafts, intercept the rod areas at and near the points and beyond the sleeves of a column of rotating rods and remove litter therefrom, said second sections being made of metal, durable plastic, or other suitable material, with each said second section being so aligned and circumscribing, at some part, on rotation, a cylinder or circle of such radius as to, upon the cooperative rotation of the said first and second shafts, rotate between the sleeves of two rotating columns of rods and dislodge litter from therebetween, and a bin for litter collection secured to said frame into which litter is discharged.

2. The device, as claimed in claim 1 further provided with one or more surface engaging wheels secured to the said first shaft.

3. The 'litter picker' as claimed in claim 1 wherein said means operably connecting both said shafts comprises a pair of aligned sprocket wheels mounted on said shafts and an endless link chain engageable with said sprocket wheels.

4. The 'litter picker' as claimed in claim 1 wherein said bin has a forward portion adjustably and detachably mounted on said frame and a cord detachably securing the rear of said bin to said frame, for maintaining said bin clear of the ground.

5. The 'litter picker' as claimed in claim 1 wherein said means for attaching said rods to said first shaft consists of a molded tubular plastic housing which has arms extending radially inward to sleeves through which the first shaft passes, said tubular housing and said sleeves having aligned holes through which the rods pass, said tubular housing being filled with concrete or other suitable material which secures said rods, shaft, and housing together, said housing further provided with a smaller end of an outside diameter such that it will push fit into an inside diameter equal to that of the larger end so that two or more molded sections of this housing can engage each other as an extended housing.

6. The 'litter picker' as claimed in claim 1 said frame being provided with means for securing said 'litter picker' to a propulsion vehicle for said 'litter picker'.

7. The 'litter picker' as claimed in claim 1 said frame being provided with a handle for manual propulsion.

8. The 'litter picker' as claimed in claim 1 wherein small pieces of metal are attached onto the said rods beyond the said sleeves to provide an improved rolling surface and to act as a stop to prevent pierced litter from being pushed up to the sleeves or both.

9. The 'litter picker' as claimed in claim 1 wherein the said second section(s) of said 'litter picker' consists of a plurality of strips, of metal or other suitable material, which are mounted radially to said second shaft.

10. The 'litter picker' as claimed in claim 1, wherein the said second section(s) of said 'litter removing device' consists of a plurality of curved tubes mounted radially to the said second shaft and presenting either convex or concave faces to the litter to be removed.

11. The 'litter picker' as claimed in claim 1, wherein the said second section(s) of the said 'litter removing device' consists of a flat-sided area(s) of metal, plastic or other suitable material mounted at or near its center on the said second shaft and shaped so that, when viewed from the periphery its peripheery forms one or more angles some of which angles, in operation, intercept and dislocate wedged litter.

12. The 'litter picker' as claimed in claim 1 wherein the said second section(s) of the 'litter removing device' consists of a cylinder brush or brushes.

* * * * *